US012467708B2

(12) United States Patent
Groves et al.

(10) Patent No.: US 12,467,708 B2
(45) Date of Patent: Nov. 11, 2025

(54) BULLET TRAP BLANK FIRING ATTACHMENT FOR USE WITH A FIREARM

(71) Applicant: COLT CANADA CORPORATION, Kitchener (CA)

(72) Inventors: Blaine Groves, Kitchener (CA); Steven John Samborsky, Kitchener (CA); Glen E. Kulchecki, Kitchener (CA); Jeffrey A Dukes, Kitchener (CA)

(73) Assignee: COLT CANADA CORPORATION, Kitchener (CA)

( * ) Notice: Subject to any disclaimer, the term of this patent is extended or adjusted under 35 U.S.C. 154(b) by 17 days.

(21) Appl. No.: 18/687,393

(22) PCT Filed: Aug. 30, 2022

(86) PCT No.: PCT/CA2022/051310

§ 371 (c)(1),
(2) Date: Feb. 28, 2024

(87) PCT Pub. No.: WO2023/028700

PCT Pub. Date: Mar. 9, 2023

(65) Prior Publication Data

US 2024/0384960 A1 Nov. 21, 2024

Related U.S. Application Data

(60) Provisional application No. 63/238,319, filed on Aug. 30, 2021.

(51) Int. Cl.
*F41A 21/26* (2006.01)

(52) U.S. Cl.
CPC ..... *F41A 21/26* (2013.01)

(58) Field of Classification Search
CPC ..... F41A 21/26; F42B 30/06
See application file for complete search history.

(56) References Cited

U.S. PATENT DOCUMENTS 1,671,327 A * 5/1928 Studler ..... F41A 21/26 89/14.5
3,137,204 A * 6/1964 Harvey ..... F41A 21/26 89/193

(Continued)

FOREIGN PATENT DOCUMENTS

CA 2665565 A1 11/2010
EP 2657640 A2 10/2013

OTHER PUBLICATIONS

The International Search Report for the corresponding PCT Application No. PCT/CA2022/051310 dated Nov. 1, 2022.

*Primary Examiner* — Derrick R Morgan
(74) *Attorney, Agent, or Firm* — Gowling WLG (Canada) LLP

(57) ABSTRACT

The disclosure is directed at a blank fire bullet trap attachment (BFBTA) that provides improved protection for firearm users when live ammunition is accidently loaded into the firearm. The BFBTA includes a barrel portion made of a first metal; and a hardened element portion made of a second metal, the hardened element portion sized to frictionally fit within the pipe portion; wherein the first metal is softer than the second metal, such that when live ammunition contacts the hardened element portion, the hardened element portion slides within the barrel portion.

7 Claims, 11 Drawing Sheets

(56) References Cited

U.S. PATENT DOCUMENTS 3,440,924 A * 4/1969 Sawyer ..... F41A 21/26 42/79
3,664,263 A * 5/1972 Driscoll ..... F41A 21/26 42/105
3,732,776 A * 5/1973 Snodgrass ..... F41A 21/26 89/14.5
3,766,822 A * 10/1973 Sophinos ..... F41A 21/26 89/14.5
5,325,758 A * 7/1994 Compton ..... F41A 21/26 89/14.5
5,377,438 A * 1/1995 Sheinfeld ..... F41A 35/04 42/106
5,574,245 A * 11/1996 Buc ..... F42B 30/06 42/105
5,983,772 A * 11/1999 Reynolds ..... F41A 21/10 42/77
6,289,623 B1 * 9/2001 Cohen ..... F41A 21/26 102/485
6,889,593 B2 * 5/2005 Guhring ..... F41A 21/26 42/96
7,290,475 B2 * 11/2007 Fluhr ..... F41A 21/34 89/14.5
8,156,855 B2 * 4/2012 Anderson ..... F41A 21/32 89/14.05
8,763,510 B2 * 7/2014 Dueck ..... F41A 21/26 89/14.4
9,038,540 B2 * 5/2015 Brosky ..... F41F 1/06 102/485
9,494,396 B2 * 11/2016 Peter ..... F42B 8/12
12,031,792 B2 * 7/2024 Genna ..... F41A 33/00
2006/0243125 A1 * 11/2006 La France ..... F41A 21/26 89/31
2010/0281747 A1 * 11/2010 Anderson ..... F41A 21/26 42/90
2014/0173963 A1 * 6/2014 Kent ..... F41A 21/32 42/90
2018/0292163 A1 * 10/2018 Ellis ..... F42B 12/02
2018/0340749 A1 * 11/2018 Palu ..... F41A 21/30
2019/0170475 A1 * 6/2019 Malarkey ..... F41B 11/60

* cited by examiner

BULLET TRAP BLANK FIRING ATTACHMENT FOR USE WITH A FIREARM

CROSS-REFERENCE TO OTHER APPLICATIONS

The disclosure claims priority from U.S. Provisional Application No. 63/238,319 filed Aug. 30, 2021 which is hereby incorporated by reference.

FIELD

The disclosure is generally directed at firearms, and more specifically, at a bullet trap blank firing attachment for use with a firearm.

BACKGROUND

A firearm is seen as being 'gas operated' if it uses high pressure propellant gases to cycle the firearm, ejecting the spent cartridge and loading the next round when fired. Gas operated systems are typically used on semi-automatic and/or fully automatic firearms.

For training purposes, users will use blank ammunition with their firearms, however, blank ammunition does not generate sufficient gas pressure to cycle the firearm due to the lack of a projectile. To allow the firearm to function properly in training scenarios, a blank firing attachment (BFA) is installed on the firearm. This creates a partial obstruction of the barrel, effectively plugging it (though providing minor venting), and generating sufficient back-pressure to allow the gas system to cycle the firearm.

In a training environment, such as through human error, live ammunition can be introduced into the firearm. If live ammunition is fired into a BFA, severe damage to the BFA will occur. Additionally, the projectile (or bullet) can leave, or exit the weapon, or firearm, with significant velocity presenting a hazard to the firearm user and those who are close to the firearm user or in the line of fire. Furthermore, due to its contact with the projectile, bullet, or live ammunition, the BFA may be disengaged from the firearm and no longer installed on the firearm, such that any subsequent live rounds may be free to fire from, or exit, the weapon unimpeded. This risk is present for semi-automatic firearms but is more extreme in an automatic fire scenario or when the BFA is attached to an automatic firearm. Within a burst of live ammunition fire, the first round will impact the BFA destroying it and many subsequent live rounds could be fired without the user being aware of the danger of firing unimpeded live ammunition in a training environment.

In most current BFAs, though it will obscure the exit of the first round of live ammunition, many are not effective in preventing, or protecting individuals from, the hazard of even one live round being fired into it.

To address this problem, devices known as a Bullet Trap BFA, or BTBFA, have been designed to safely stop and contain a small amount of live ammunition being fired into it by accident. Typically, these devices are able to stop either a single round of live ammunition or up to three rounds of live ammunition. These are typically known as a single round BTBFA or a three round BTBFA, respectively. These devices operate as a normal BFA when using blank ammunition but are less damaged once shot with live ammunition than a BFA and provide further safety by stopping inadvertently fired live rounds. Typically, the BTBFA device is discarded and replaced with a new after an incident, however, being able to handle a single round or up to three rounds of live ammunition may still not provide the safety required when live ammunition is fired into the BTBFA.

Therefore, there is provided a novel bullet trap blank firing attachment for use with a firearm.

SUMMARY

In one aspect of the disclosure, there is provided a blank fire bullet trap attachment (BFBTA) including a barrel portion made of a first metal; and a hardened element portion made of a second metal, the hardened element portion sized to frictionally fit within the pipe portion; wherein the first metal is softer than the second metal, such that when live ammunition contacts the hardened element portion, the hardened element portion slides within the barrel portion; and wherein it takes more than three live rounds to displace the hardened element portion from the barrel portion.

In another aspect, the BFBTA includes a cap portion for mounting the BFBTA to a firearm. In a further aspect, the cap portion includes a threaded portion for attachment of the cap portion to the barrel portion. In yet another aspect, the barrel portion includes a set of vent holes. In yet a further aspect, the hardened element portion includes at least one vent hole. In an aspect, the first metal is aluminium or a malleable steel alloy. In another aspect, the the second metal is armour grade steel, tool steel or a nickel based superalloy.

BRIEF DESCRIPTION OF THE DRAWINGS

Embodiments will now be described, by way of example only, with reference to the attached drawings, in which.

DETAILED DESCRIPTION

The disclosure is directed at a bullet trap blank firing attachment (BTBFA) for use with a firearm. In one embodiment, the BTBFA provides a warning and/or protection for firearm users when live ammunition is incorrectly loaded into the firearm when blanks are expected. Compared with current solutions, the BTBFA of the disclosure is able to handle more live rounds and therefore provides more protection than current solutions.

Figure 1:
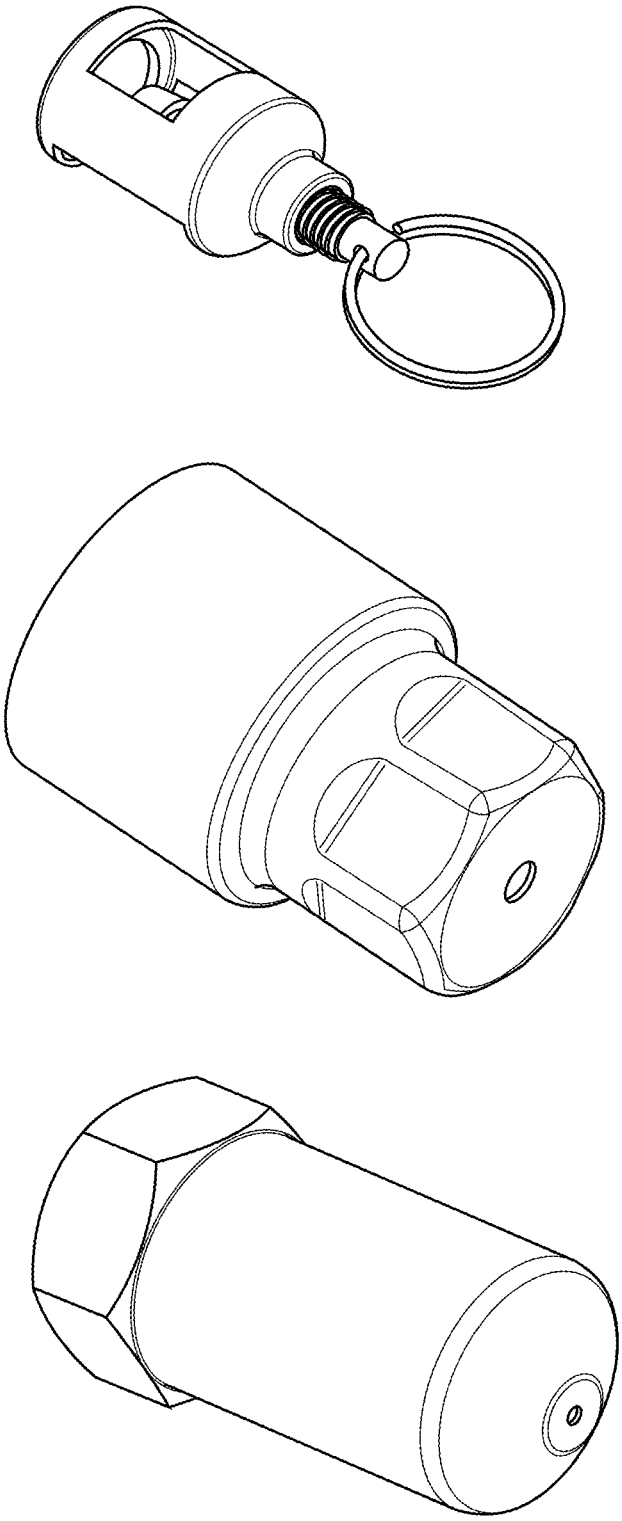
Figure 1 (PRIOR ART)
FIG. 1 shows prior art blank firing attachments (BFAs)
Figure 2A:
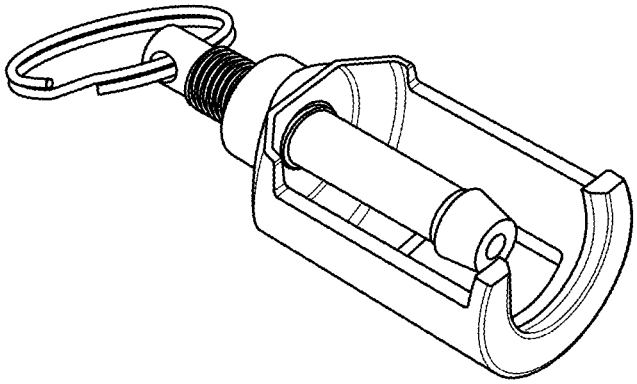
Figure 2a (PRIOR ART)
FIG. 2*a* is a schematic diagram of a BFA before it has experienced a live round.
Figure 2B:
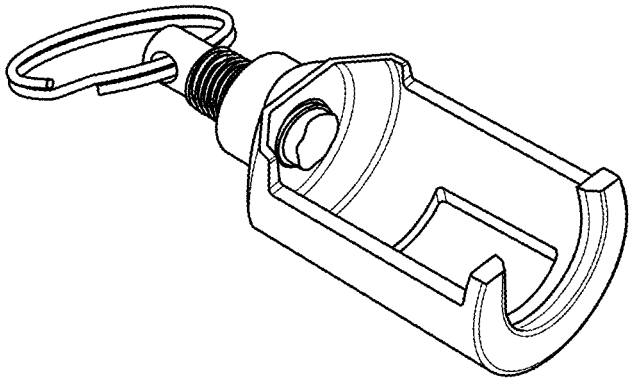
Figure 2b (PRIOR ART)
FIGS. 2*b* and 2*c* are schematic diagrams of the BFA of FIG. 2*a* after being shot with live ammunition.
Figure 2C:
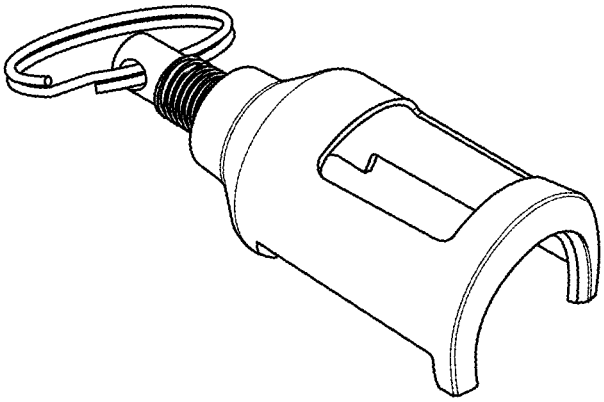
Figure 2c (PRIOR ART)

Examples of current blank firing attachments (BFAs) are shown in FIG. 1. Mounting of one of these BFAs to the end of a firearm allows the firearm to function properly in training scenarios when blank ammunition is being used. FIGS. 2*a* to 2*c* are photographs showing a BFA prior to use (FIG. 2*a*) and a BFA after it has been shot with live ammunition (FIGS. 2*b* and 2*c*). As can be seen, if live ammunition is loaded into the firearm by accident, the BFA may explode and cause injury to firearm user or other individuals who are in proximity to the individual when the live ammunition is shot. This typically occurs after a minimal (or low) amount or minimal (or low) number of rounds of live ammunition is fired into the BFA.

Figure 3:
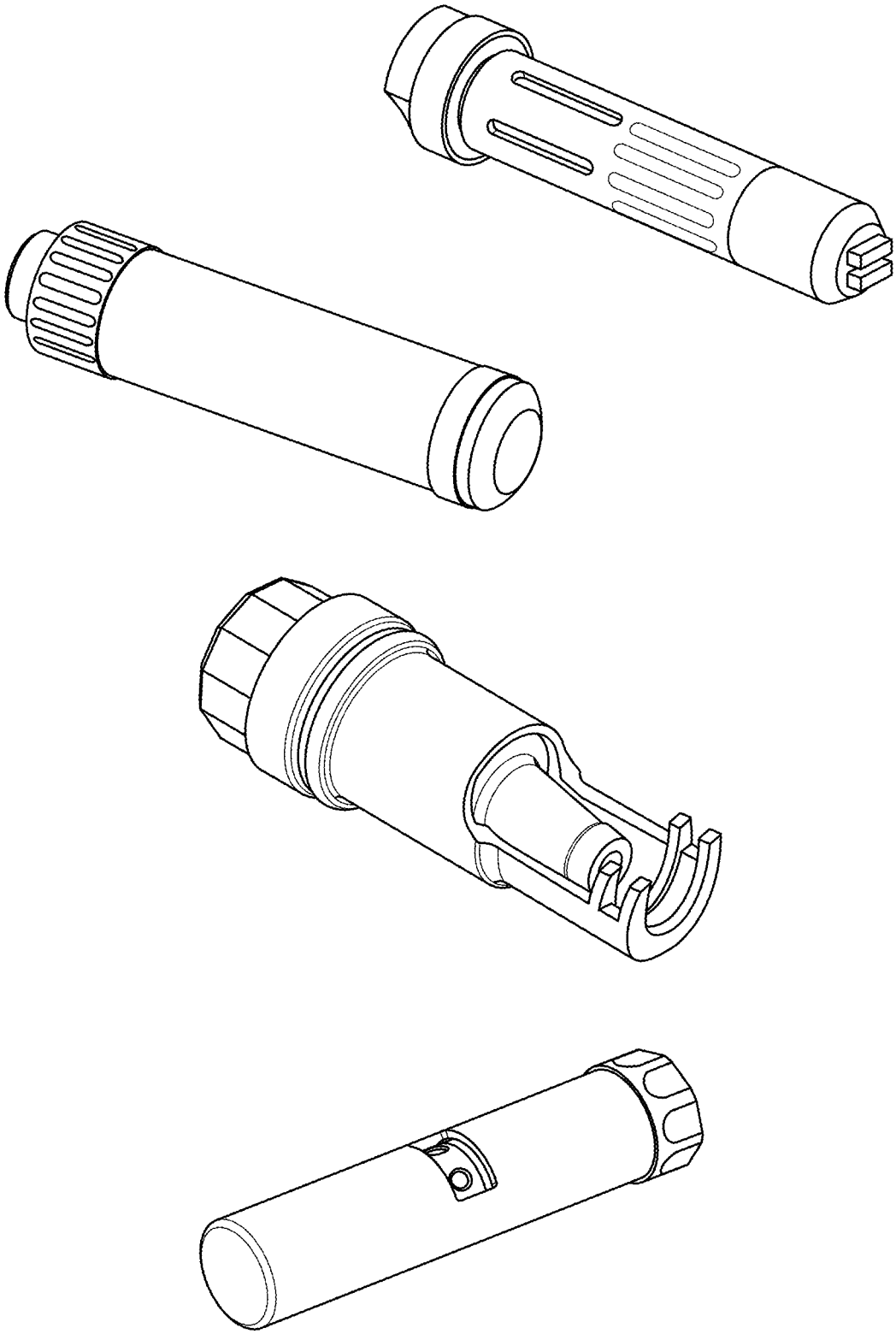
Figure 3 (PRIOR ART)
FIG. 3 shows prior art bullet trap BFAs.

BTBFAs were designed to safely stop and contain a small amount of live ammunition such that if live ammunition was accidently loaded into the firearm, the BTBFA would reduce the likelihood that the live ammunition would exit the firearm by absorbing the impact of the live ammunition and preventing it from exiting the barrel portion of the firearm. Examples of current BTBFAs are shown in FIG. 3.

The disclosure is directed at an improved BTBFA that is able to handle more live ammunition rounds than current solutions thereby improving protection for the firearm user and others proximate the firearm or firearm user when live ammunition is accidently loaded into a firearm. Current solutions may be able to handle around three rounds of live ammunition before it is no longer effective while the disclosure is able to handle more rounds of live ammunition before losing some effectiveness.

Figure 4:
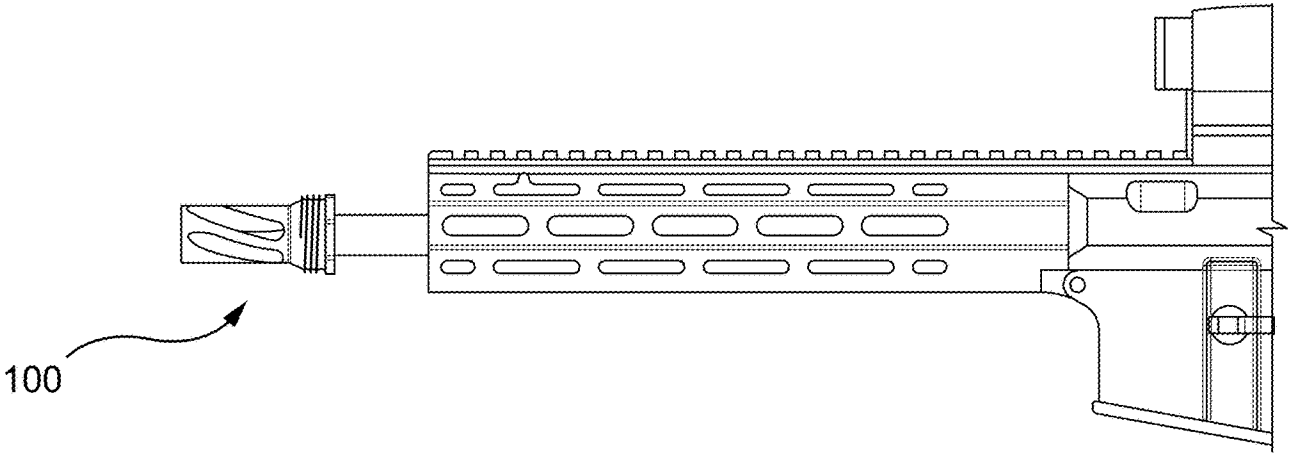
FIG. 4 is a side view of an end portion of a firearm

Turning to FIG. 4, a side view of an end portion of a firearm is shown. In the current figure, the firearm 100 is a MRR carbine. It is understood that the BTBFA of the disclosure may be designed to fit with or be mounted to any type of firearm.

Figure 5:
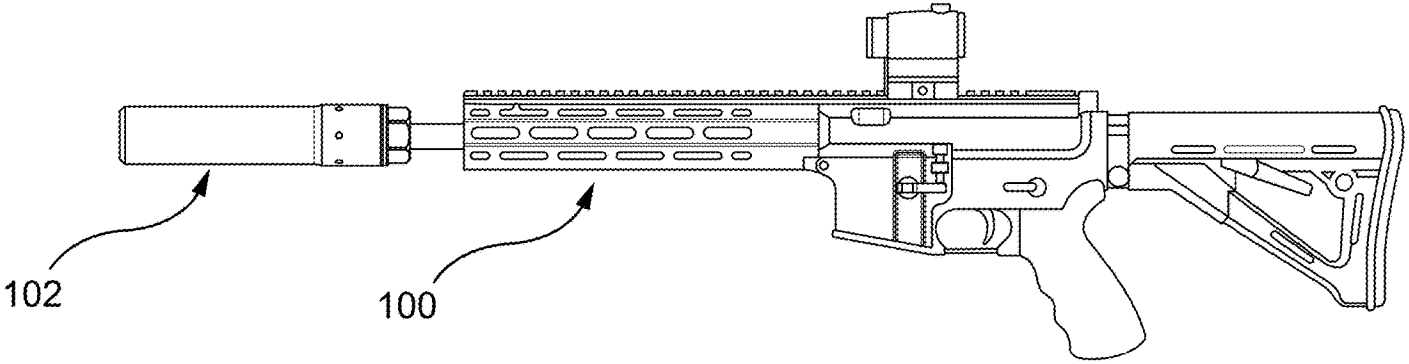
FIG. 5 is a side view of the firearm of FIG. 4 with a BTBFA in accordance with an embodiment of the disclosure.

FIG. 5 provides a side view of the firearm of FIG. 4 with a BTBFA in accordance with an embodiment of the current disclosure attached. In the current embodiment, the BTBFA 102 is mounted to, or integrated with, the firearm 100, via a threaded connection. Other methods of integrating the BTBFA with a firearm are also contemplated, such as, but not limited to, using a locking collar. As can be seen in FIG. 5, the BTBFA 102 provides an extension to the firearm 100. In some embodiments, the BTBFA 102 may mimic the envelope and weight of a suppressor, or silencer, to provide consistency between training and real-life engagements. Further details relating to the BTBFA 102 is provided below.

Figure 6:
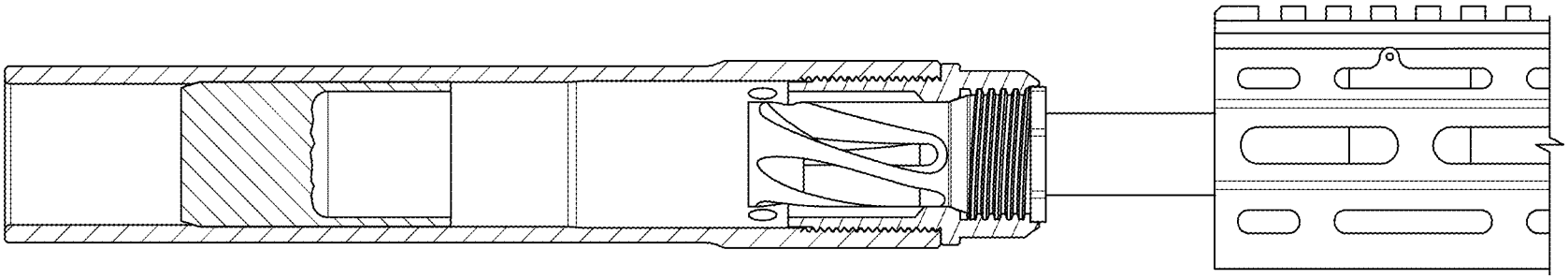
FIG. 6 is a photograph of a BTBFA of the disclosure after 60 live rounds were fired into the BTBFA.

In testing of the disclosure, an embodiment of the BTBFA captured up to 90 rounds of automatic (live) fire in a single test (without allowing live ammunition from exiting the BTBFA) which provides a significant improvement over current BTBFAs. Even in embodiments of the disclosure which may be able to handle 30 rounds of live ammunition, this is a significant improvement over current solutions. By being able to handle more live rounds, there is further safety provided to the firearm user and/or individuals proximate the user or firearm if live ammunition is mistakenly fired or loaded into the firearm. FIG. 6 provides a photograph of a BTBFA of the disclosure after 60 live rounds were fired into the BTBFA. As can be seen in FIG. 6, the BFBTA is still intact after 60 live rounds such that the BFBTA is able to withstand more live ammunition rounds than current solutions.

Figure 7:
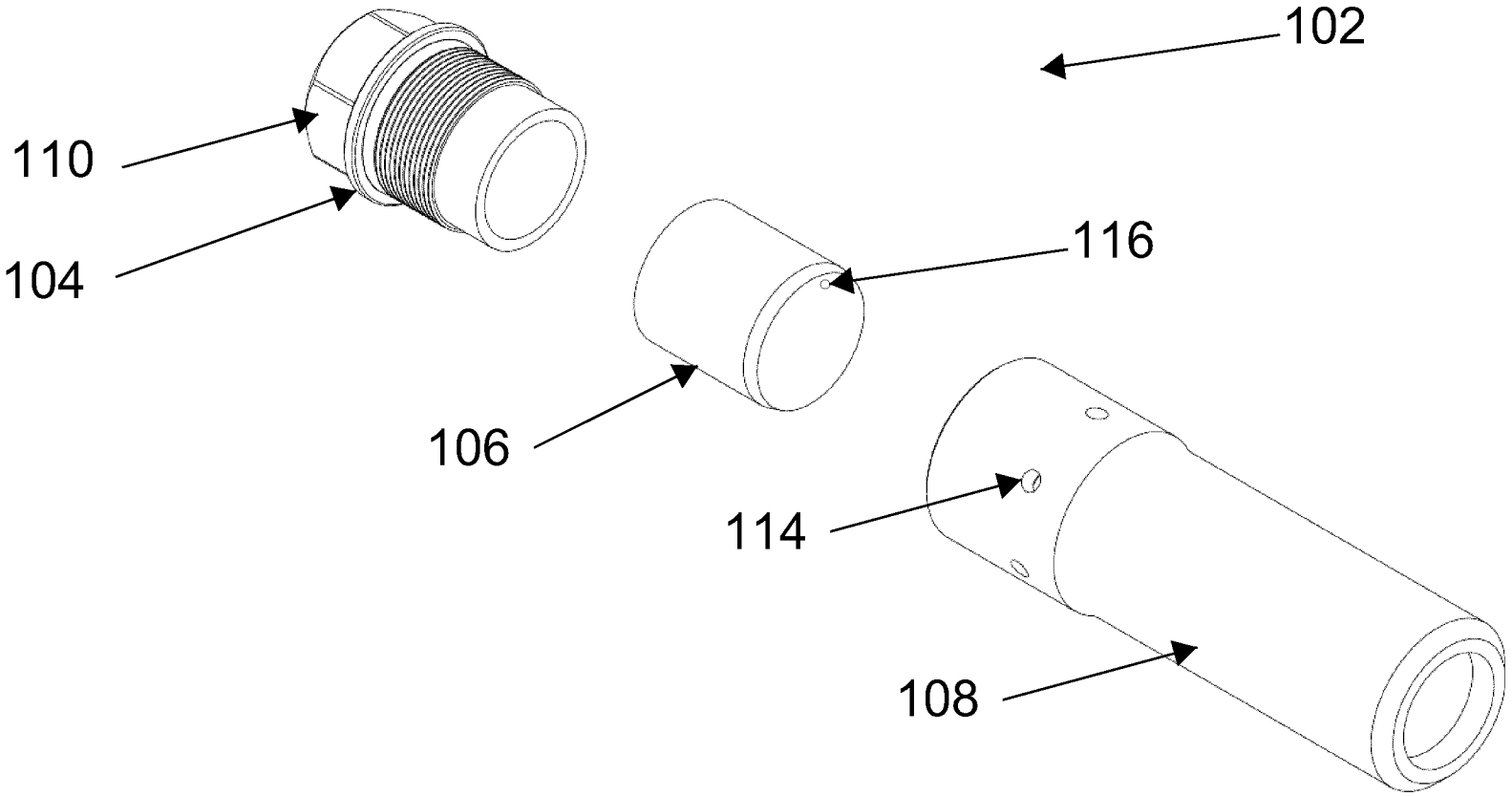
FIG. 7 is a perspective exploded view of a BTBFA in accordance with the disclosure.

Turning to FIG. 7, a perspective exploded view of a BTBFA in accordance with the disclosure is shown. In the current embodiment, the BTBFA 102 includes a cap portion 104, a hardened element portion 106 and a pipe, or barrel, portion 108. The cap portion 104 (having a hollow central portion) includes a firearm connection part 110 that includes an internal threaded portion (not shown) that enables the BTBFA 102 to be attached, or mounted, to the end of the firearm. The cap portion 104 also includes a threaded portion 112 that enables the cap portion 104 to be attached to a corresponding threaded portion within the barrel portion 108.

Figure 8:
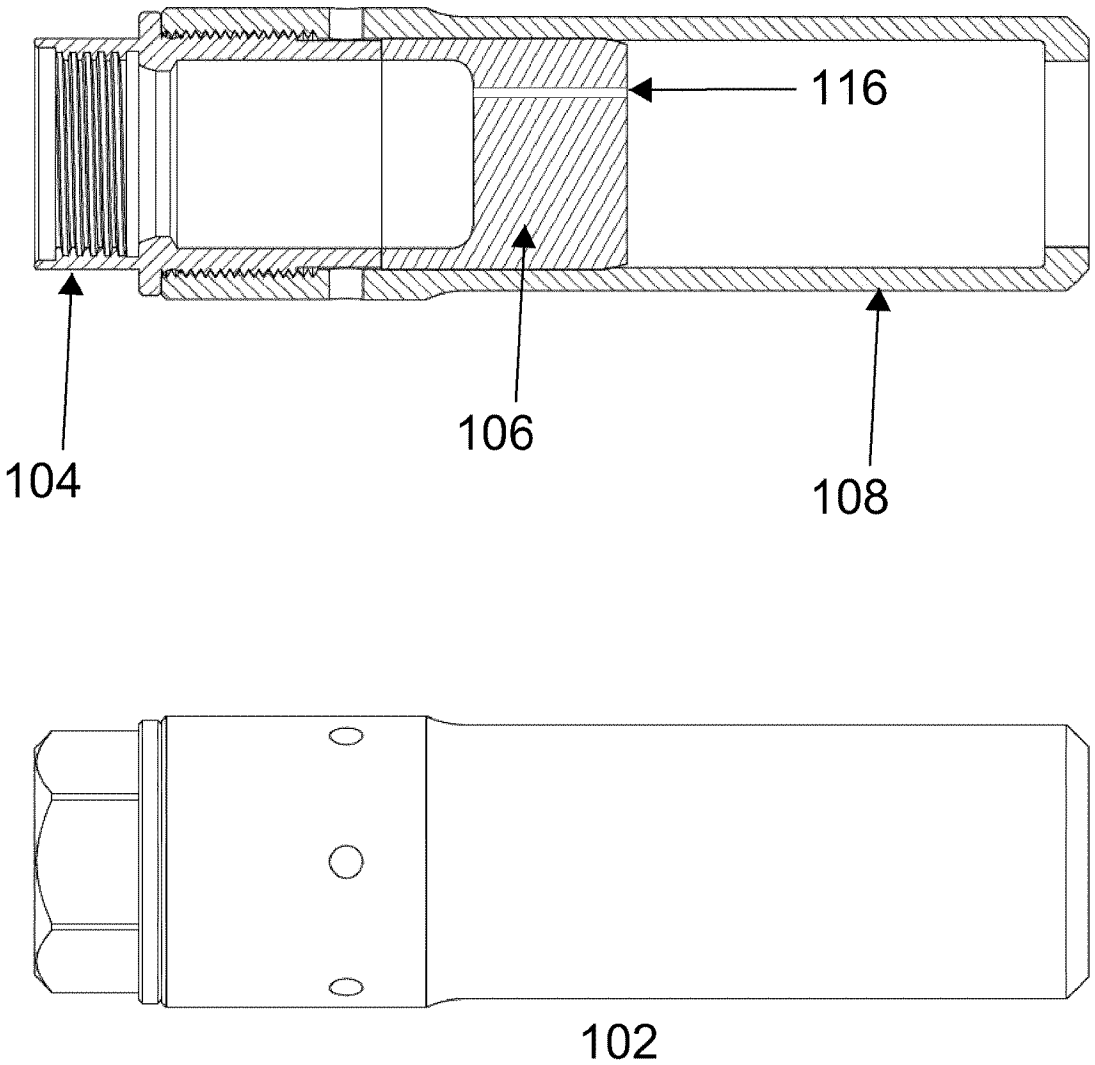
FIG. 8 is side view of a BTBFA in accordance with the disclosure.

The hardened element portion 106 is sized to frictionally fit within the barrel portion 108 when the barrel portion 108 is attached to the cap portion 104. This is shown in more detail in FIG. 8 which shows the cap portion 104, the hardened element portion 106 and the barrel portion 108 assembled together to form the BTBFA 102. In the current embodiment, the barrel portion 108 (as shown FIG. 7) includes a set of vent holes 114. The functionality of the vent holes 114 will be discussed in more detail below. The hardened element portion 106 may include a vent hole 116 (FIG. 8) to accommodate the use of blank ammunition. The vent hole 116 allows gas to pass through when blank ammunition is being fired. Depending on the type of ammunition being used, other embodiments of the hardened element portion 106 may not have a vent hole.

In use, when blank ammunition is fired through the firearm, the presence of the BTBFA enables the firearm to cycle even though there is no projectile (or live ammunition) present. When live ammunition is accidently loaded into and shot by the firearm, the live ammunition passes through the cap portion 104 and contacts the hardened element 106 causing the hardened element 106 to slide away from the cap portion 104 (or firearm end) and down the barrel portion 108.

Figures 9A, 9B:
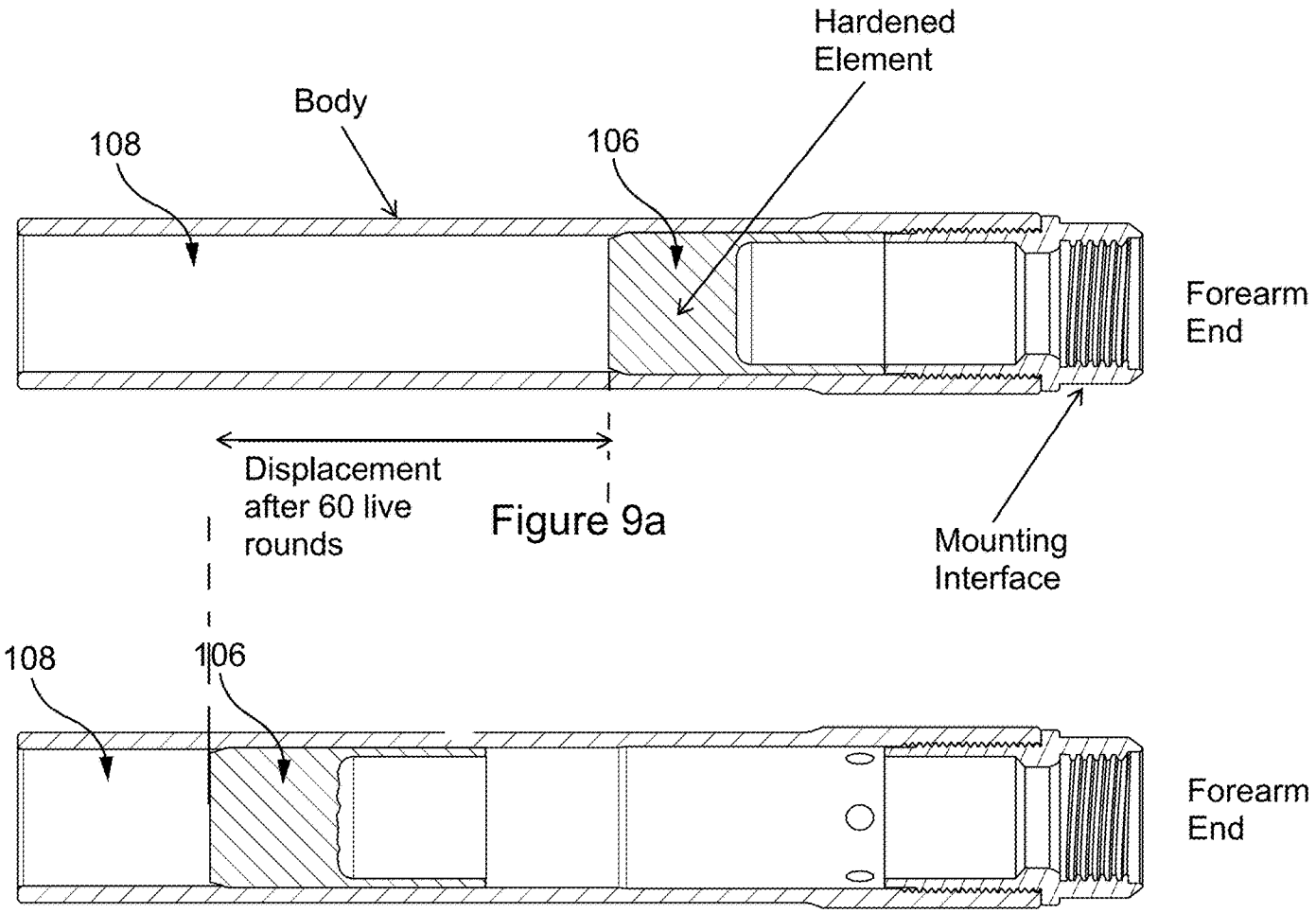
FIG. 9*a* shows an unused BTBFA in accordance with the disclosure.
FIG. 9*b* shows the BTBFA of FIG. 9*b* after 60 rounds of live ammunition have been shot through the BTBFA.

FIG. 9*a* is a photograph showing an unused BTBFA of the current disclosure and FIG. 9*b* is a photograph showing the BTBFA after 60 rounds of live ammunition has been shot through the BTBFA. As can be seen, after 60 rounds of "accidental" live round ammunition fire, the hardened element portion 106 of the BTBFA 102 remains in the barrel portion 108 thereby still protecting against further live ammunition being fired out of, or by, the firearm. This provides added protection (over current solutions) for the firearm user (and others around the firearm user) when many rounds of live ammunition are accidently fired such as during training exercises when blank ammunition is supposed to be, or expected to be, used.

Figure 10:
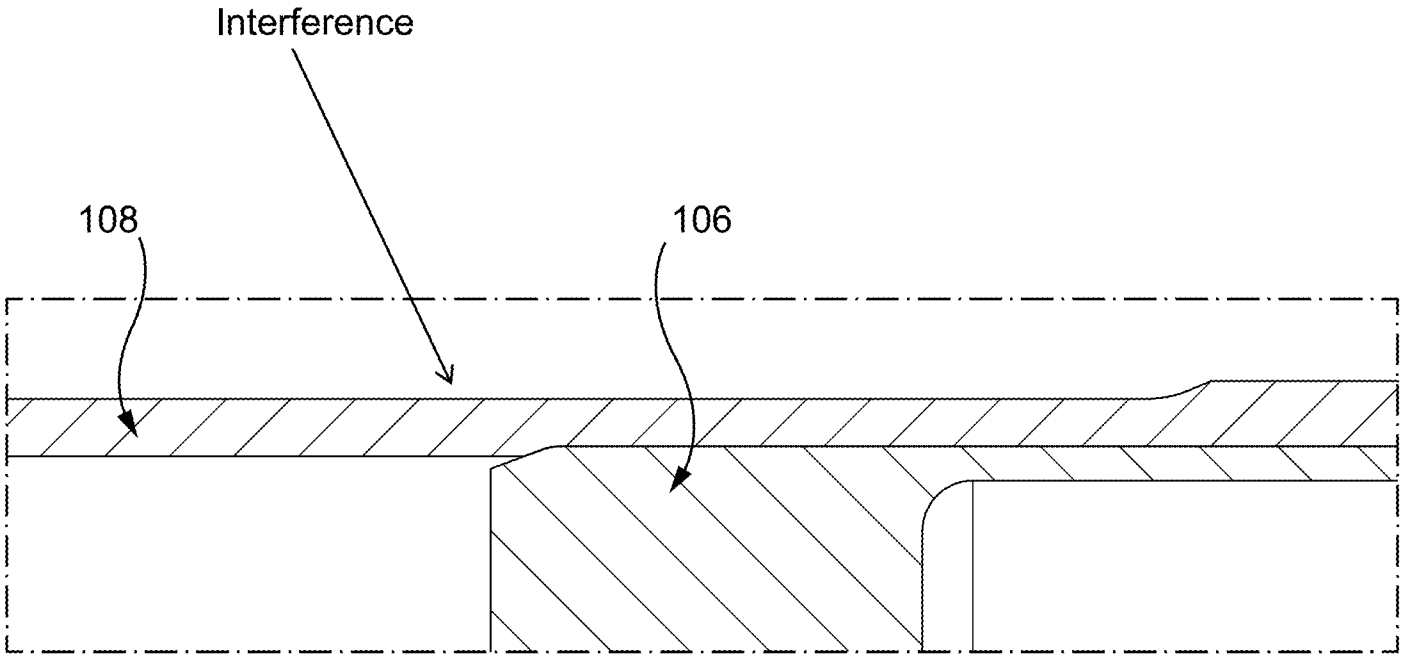
FIG. 10 is a schematic diagram showing a friction fit between a hardened element and the barrel portion of a firearm.

The friction fit, or interference, between the hardened element 106 and the barrel portion 108 (more clearly seen in FIG. 10) stops the hardened element 106 from completely sliding out of the barrel portion 108 when contacted by a low or limited number of live rounds, such as under 10, of live ammunition as with many current BTBFAs. Instead, movement of the hardened element portion 106, with respect to the barrel portion 108, is restricted by the friction fit between the hardened element portion 106 and the inside of the barrel portion 108. Selection of a softer metal, such as, but not limited to, aluminium or malleable steel alloys for the barrel portion 108 and a harder metal, such as, but not limited to, armour grade steel, tool steel and nickel based superalloys, for the hardened element portion 106, allow the hardened element portion 106 to receive more live rounds of ammunition than current BTBFAs before exiting the barrel portion 108, thereby providing further advantages and/or protection over current BFAs and BTBFAs.

In a general embodiment, the material of the hardened element portion 106 should be hard/tough enough to reduce, eliminate or prevent penetration by the live ammunition. In another general embodiment, the material of the barrel portion 108 should be malleable enough based on its material properties and/or geometry to deform allowing the hardened element portion 106 to move a short distance within the barrel portion with each live ammunition shot to reduce peak forces.

Unlike current BTBFAs, the BTBFA of the disclosure uses a novel approach to capture multiple live rounds. Whereas existing products use rigidly supported hardened elements that typically break or fail to block live ammunition after a limited number of, say 10, live rounds, the BTBFA of the disclosure allows for controlled movement of the hardened element portion 106 with each impact from a live round. This is achieved by the interference, or friction, fit between the hardened element portion and the body, or barrel portion 108 of the BTBFA 102. This interference causes the body, or inside of the barrel portion, to be deformed as the hardened element portion 106 is pushed axially down the barrel portion by the impact of the live ammunition against the hardened element. Because of this small incremental movement, peak stresses on the hardened element portion 106 and the mounting system of the firearm are greatly reduced. These reduced forces translate into the ability of the parts and assembly of the firearm to survive a much greater number of impacts compared to current solutions. The interference may be varied by design model to tune the resistance provided by the friction interference. This may enable a manufacturer or designer to select the number of live ammunition rounds a BFBTA may be able to handle before sliding out of the barrel portion.

Figure 11:
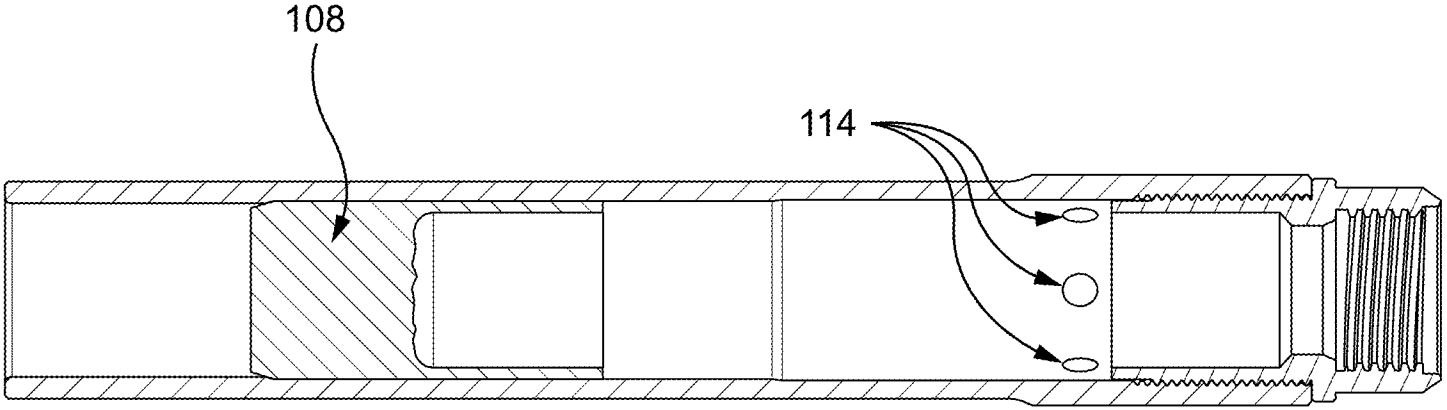
FIG. 11 is a schematic diagram of a barrel portion of a firearm.

As discussed above, and as shown in FIG. 11, the barrel portion 108 includes a set of vent holes 114. The set of vent holes 114 may provide further safety to the firearm user and those who are near the firearm user.

When the hardened element is in its normal operating, or initial, position, having not been hit by a live round, it blocks the series, or set, of vent holes 114. In this position, the backpressure provided to the gas system allows the firearm to function normally with blank ammunition. Once the hardened element portion 106 is struck by at least one live round, it is displaced axially away from the firearm thereby exposing the vent holes 114.

Figure 12:
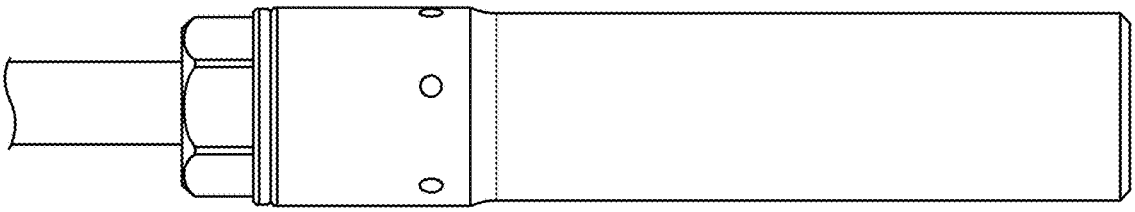
FIG. 12 is a schematic diagram of a BTBFA of the disclosure prior to firing.
Figure 13:
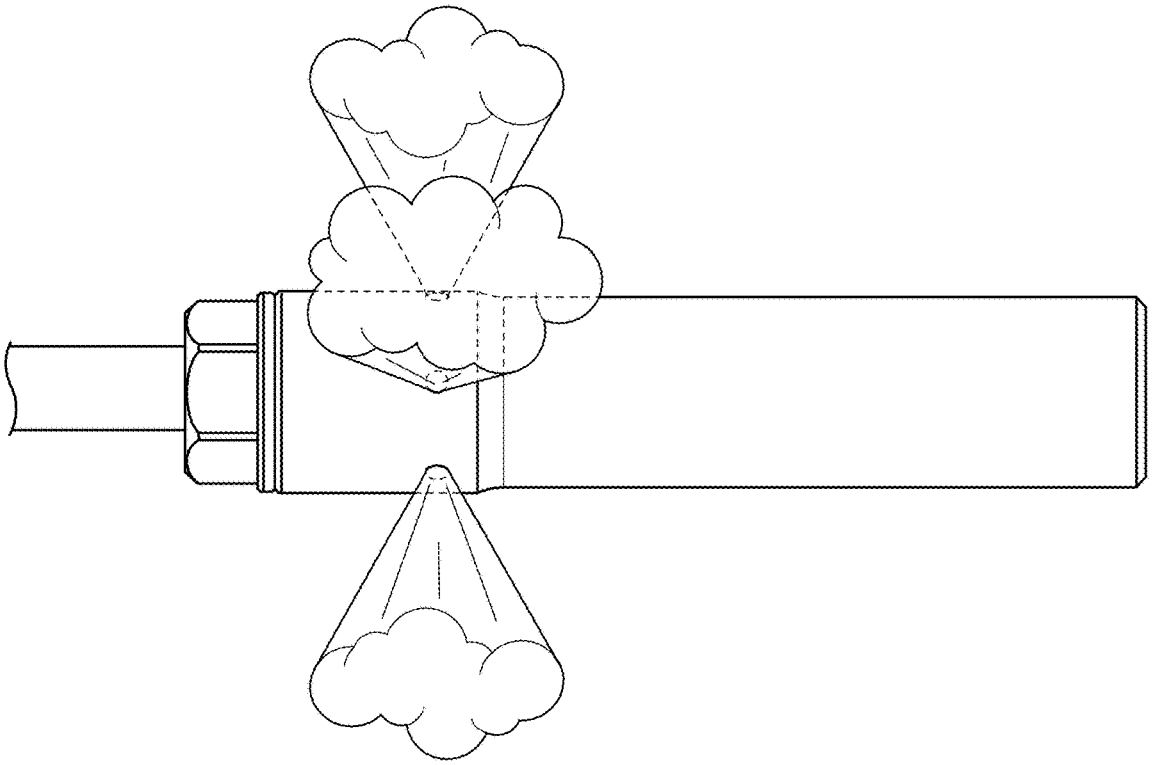
FIG. 13 is a schematic diagram of a BTBFA of the disclosure after live ammunition has been fired into the BTBFA.

Exposure of the vent holes combined with the firing of a live round generates, or provides, a distinct visual (presence of smoke/gas) and/or audible indication to the firearm user and others surrounding the firearm user that a live round has been fired into the BTBFA. FIG. 12 shows a BTBFA of the disclosure prior to firing (or contact with live ammunition) and FIG. 13 shows a BTBFA of the disclosure after live ammunition, or a live round, has been fired into the BTBFA. As can be seen, once the vent holes are exposed, smoke exits the vent holes providing a visual indication that live ammunition has been fired by the firearm. Any subsequent firing of live rounds by the firearm can occur, but the noticeably louder sound and visual puff of smoke/gas will continue to alert the firearm user and surrounding individuals. Along with the ability for the BFBTA of the disclosure to receive an increased number of rounds of live ammunition without exiting the barrel portion, the apparatus of the disclosure provides increased and improved safety for firearm users and others around the firearm user in training environments when live ammunition is mistakenly fired.

Furthermore, another advantage of the vent holes 114 is that even if the user does not realize that a problem has occurred, if blank ammunition is subsequently fired by the firearm, the exposed vent holes vent too much gas for the firearm to continue to cycle when using blank ammunition effectively stopping the firearm from firing blank ammunition. In other words, the firearm will stop functioning with blank ammunition once the vent hole, or holes, is or are exposed (due to contact with live ammunition) providing another indication that something is wrong with the firearm.

In a further embodiment, as there may be particulates present in the gas escaping through the vent holes 114, the BFBTA may include a shielding collar to direct the gas/particulates away from the firearm user (or in any other direction). The shielding collar may be located within the BFBTA, may be located within the barrel portion 108 or may be mounted to an outside surface of the barrel portion 108.

In the preceding description, for purposes of explanation, numerous details are set forth in order to provide a thorough understanding of the embodiments. However, it will be apparent to one skilled in the art that these specific details may not be required. In other instances, well-known structures may be shown in block diagram form in order not to obscure the understanding.

The above-described embodiments are intended to be examples only. Alterations, modifications and variations can be effected to the particular embodiments by those of skill in the art without departing from the scope, which is defined solely by the claims appended hereto.

Although the present disclosure has been illustrated and described herein with reference to various embodiments and specific examples thereof, it will be readily apparent to those of ordinary skill in the art that the elements of the embodiments may be combined in other ways to create further embodiments and also other embodiments and examples may perform similar functions and/or achieve like results. All such equivalent embodiments and examples are within the spirit and scope of the present disclosure as defined by the claims.

In the preceding description, for purposes of explanation, numerous details may be set forth in order to provide a thorough understanding of the embodiments. However, it will be apparent to one skilled in the art that these specific details may not all be required. In other instances, well-known structures may be shown in block diagram form in order not to obscure the understanding.

What is claimed is:

1. A blank fire bullet trap attachment (BFBTA) comprising:

a barrel portion made of a first metal; and a hardened element portion made of a second metal, the hardened element portion sized to frictionally fit within the barrel portion;

wherein the first metal is softer than the second metal, such that when live ammunition contacts the hardened element portion, the hardened element portion slides within the barrel portion; and wherein the hardened element portion is configured to be displaced from an open end of the barrel portion when the hardened element portion is impacted by and displaced by more than three live rounds.

2. The BFBTA of claim 1 further comprising a cap portion for mounting the BFBTA to a firearm.

3. The BFBTA of claim 2 wherein the cap portion comprises a threaded portion for attachment of the cap portion to the barrel portion.

4. The BFBTA of claim 1 wherein the barrel portion comprises a set of vent holes.

5. The BFBTA of claim 1 wherein the hardened element portion comprises at least one vent hole.

6. The BFBTA of claim 1 wherein the first metal is aluminium or a malleable steel alloy.

7. The BFBTA of claim 1 wherein the second metal is armour grade steel, tool steel or a nickel based superalloy.

* * * * *